US006755418B1

(12) United States Patent
Jackson

(10) Patent No.: US 6,755,418 B1
(45) Date of Patent: Jun. 29, 2004

(54) WHAT'S FOR DINNER BOARD GAME

(76) Inventor: Wayne L Jackson, 5534 Rosemont Ave., Washington Park, IL (US) 62204

( * ) Notice: Subject to any disclaimer, the term of this patent is extended or adjusted under 35 U.S.C. 154(b) by 0 days.

(21) Appl. No.: 10/369,492

(22) Filed: Feb. 20, 2003

(51) Int. Cl.[7] ..... A63F 3/00
(52) U.S. Cl. ..... 273/243; 273/445
(58) Field of Search ..... 273/236, 243, 273/246, 139, 146, 300, 308, 445

(56) References Cited

U.S. PATENT DOCUMENTS 4,003,577 A * 1/1977 Bolach ..... 273/243
4,398,721 A * 8/1983 McKay ..... 273/249

* cited by examiner

*Primary Examiner*—V K Mendiratta
(74) *Attorney, Agent, or Firm*—Michael I Kroll

(57) ABSTRACT

A board game includes a game board with four food groups represented on four sides by individual spaces for particular food items in the food group. The object is to complete the preparation of a food item from each group. Each space assigns a preparation time for the food item, and further time adjustments can be made through "Simmer" and "Boil" cards having time adjustments and other instructions, and by landing on a "Stew" space that adds time. Rolling numbered dice and landing on a food item starts the preparation or process. The player must then land on a "Get Cooking" space and roll a pair of dice with time amounts displayed, with the displayed time amounts being subtracted from the accumulated preparation time. The first to complete this process for four food items wins.

22 Claims, 4 Drawing Sheets

WHAT'S FOR DINNER BOARD GAME

BACKGROUND OF THE INVENTION

1. Field of the Invention

The present invention relates generally to a board game and, more specifically, to a board game based upon the preparation of a dinner in which the players must prepare a dinner consisting of food items from four food groups.

2. Description of the Prior Art

There are other board games designed for recreational activities but do not contain a board including necessary measures needed to prepare a dinner. Another difference is that other board games do not function in the same manner as the present invention with regard to the necessary objectives and procedures that must be met in order to win.

While these board games may be suitable for the purposes for which they were designed, they would not be as suitable for the purposes of the present invention, as hereinafter described.

SUMMARY OF THE PRESENT INVENTION

A primary object of the present invention is to provide a board game based on the preparation of a four course dinner.

Another object of the present invention is to provide a board game containing a pair of dice that contain various amounts of minutes marked thereon.

Yet another object of the present invention is to provide a board game containing a pair of dice that when rolled the total does not exceed eight.

Still yet another object of the present invention is to provide two decks of cards containing various instructions to affect game play.

Yet another object of the present invention is to provide a game board based on the preparation of a dinner including food groups, foods, and cooking time.

Another object of the present invention is to provide a board game where it is necessary to land on one food from each food group and deplete the related cooking time to win.

Yet another object of the present invention is to provide a board game that teaches children mathematics and provides food preparation information.

Additional objects of the present invention will appear as the description proceeds.

The present invention overcomes the shortcomings of the prior art by providing a board game for recreational use centered on the preparation of a dinner that also teaches mathematics and food preparation information. The board game is based upon the preparation of a dinner in which the players must prepare a dinner consisting of a food item from each of four food groups.

Each of the four food group items is along a separate side of the game board. Two of the corner spaces are marked with instructions either to draw a card from the "Simmer" or "Boil" stacks, and to follow the instructions on the card. A third corner is marked as "Stew" and causes the addition of 60 minutes to the accumulation of preparation/cooking times for the food item. The fourth corner is the "Get Cooking" space that serves as the starting place for the player's tokens.

The object of the game is to roll numbered dice, move the player's token and land on a food item from one of the four food groups and then continue rolling the dice and moving the token until the player's token lands on the space predefined as "Get Cooking". The food item and various game features create an accumulation of preparation/cooking time that must be eliminated. After landing on the Get Cooking space the player rolls a second pair of dice marked with various amounts of preparation/cooking times, each displayed sum of time amounts being taken from the accumulated preparation/cooking time until all accumulated time is eliminated. The first player to complete this process for a food item from each of the four food groups is the winner.

A board game is provided for a number of players, the game designed to select and prepare food items for a meal, each player accumulating a total food preparation time during play for each food item, the apparatus comprising: at least two player tokens; at least one numbered die having at least four sides, each side having a number displayed; a game board defining a platform upon which the game is played, the board having at least four sides, each side representing a group of food items, each side having a plurality of individual spaces delineated for player token advancement according to a roll of the at least one die, each delineated space representing and displaying an item of food within the group of food items represented by the side on which the space is located, and each delineated space displaying a time indicia indicating the amount of preparation time required for the item of food displayed on said delineated space, one of said game board sides having a delineated space for player token occupation at the game beginning, and one of said game board sides having a delineated preparation time penalty space displaying the amount of the time penalty; at least one time indicia die having at least four sides, each side having an amount of time displayed; at least one stack of cards, each card having an instruction, with at least one card's instruction affecting the player's board position, and with at least one card's instruction affecting the player's total preparation time accumulation, the game board further having a designated area for placement of the at least one stack of cards, the game board further having at least one delineated space having an instruction to draw from the at least one stack of cards.

In another embodiment, the number of numbered die is two and the highest combination of displayed numbers equals four.

In another embodiment, the number of numbered die is two and the highest combination of displayed numbers equals eight.

In another embodiment, the at least one numbered die is six-sided.

In another embodiment, the at least one numbered die is eight-sided.

In another embodiment, the at least one time indicia die is six-sided.

In another embodiment, the at least one time indicia die is eight-sided.

In another embodiment, the number of stacks of cards is two.

In another embodiment, the first stack has cards labeled "Simmer" and the second stack has cards labeled "Boil".

In another embodiment, the starting space is labeled "Get Cooking".

In another embodiment, one game board side is for the main course food group.

In another embodiment, one game board side is for the vegetable food group.

In another embodiment, one game board side is for the food group including soups and salads.

In another embodiment, one game board side is for the dessert food group.

In another embodiment, the board game further comprises a set of instructions.

A method of playing a board game is provided for a number of players, the game designed to select and prepare food items for a meal, each player accumulating a total food preparation time during play for each food item, the comprising the steps of: providing at least two player tokens; providing at least one numbered die having at least four sides, each side having a number displayed; providing at least one time indicia die having at least four sides, each side having an amount of time displayed; providing a game board defining a platform upon which the game is played, the board having at least four sides, each side representing a group of food items, each side having a plurality of individual spaces delineated for player token advancement according to a roll of the at least one die, each delineated space representing and displaying an item of food within the group of food items represented by the side on which the space is located, and each delineated space displaying a time indicia indicating the amount of preparation time required for the item of food displayed on said delineated space, one of said game board sides having a delineated space for player token occupation at the game beginning, and one of said game board sides having a delineated preparation time penalty space displaying the amount of the time penalty; providing at least one stack of instruction cards, each card having an instruction, with at least one card's instruction affecting the player's board position, and with at least one card's instruction affecting the player's total preparation time accumulation, the game board further having a designated area for placement of the at least one stack of cards, the game board further having at least one individual delineated space having an instruction to draw from the at least one stack of cards; placing the at least one stack of cards face down in the designated area on the game board; placing the player tokens on the delineated starting space; requiring each player to roll the at least one numbered die and to advance said player's token a number of delineated spaces to correspond with the numbered displayed on the die following the roll; requiring each player to draw an instruction card when said player's token lands on the at least one delineated space that indicates the instruction card is to be drawn, and to follow the instruction on the drawn instruction card; requiring each player to prepare a four course meal including one food item from each side of the game board, the inclusion resulting from said player's token landing on the food item; as each food item is so included: requiring the player to roll the at least one numbered die and advance said player's token until said player's token lands on a delineated food preparation space; requiring the player to roll the at least one time indicia die until time amounts displayed on the rolled die equals or exceeds the newly included food item's designated preparation time, as adjusted by any preparation time adjustments that are made per the instruction card instructions or the preparation time penalty space penalty; requiring the player to return to the numbered die after so equaling or exceeding said time amounts for the first three included food items; declaring the player who equals or exceeds said time amounts for the fourth included food item as the winner.

In another embodiment, the delineated food preparation space is labeled "Get Cooking"

In another embodiment, the delineated food preparation space is labeled "Get Cooking" and is the same space as the starting space for player tokens.

In another embodiment, one game board side is for the main course food group.

In another embodiment, one game board side is for the vegetable food group.

In another embodiment, one game board side is for the food group including soups and salads.

In another embodiment, one game board side is for the dessert food group.

The foregoing and other objects and advantages will appear from the description to follow. In the description reference is made to the accompanying drawings, which form a part hereof, and in which is shown by way of illustration the preferred embodiment in which the invention may be practiced. This embodiment will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
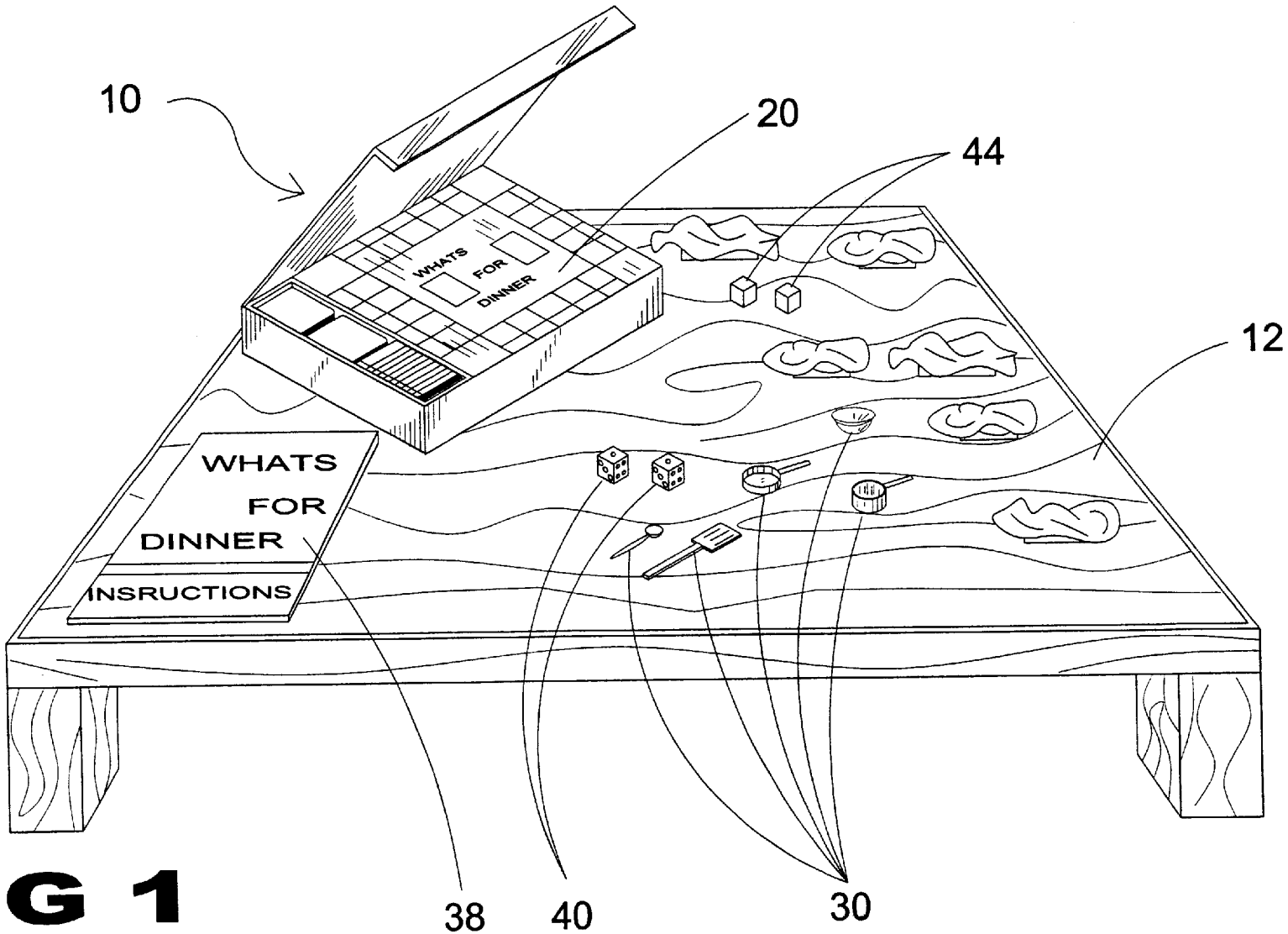
FIG. 1 is a perspective view of the present invention showing the present invention having a game board, various game pieces, an instruction manual and two pairs of dice.

Turning now descriptively to the drawings, in which similar reference characters denote similar elements throughout the several views, the figures illustrate the What's For Dinner Game? apparatus of the present invention. With regard to the reference numerals used, the following numbering is used throughout various drawing figures.

10 What's For Dinner? game of the present invention
12 game table
20 game board
22 game board first side
24 game board second side
26 game board third side
28 game board fourth side
30 player game tokens
32 stack of "Simmer" cards
34 stack of "Boil" cards
36 title and design image

38 instructions
40 first pair of dice—numbers
42 numbers on first pair of dice
44 second pair of dice—time amounts
46 time indicia on second pair of dice
50 "Get Cooking" space
52 "Main Course" spaces/food items
54 designation on "Main Course" spaces identifying type of meat
56 designation on "Main Course" spaces assigning preparation/cooking time
60 "Simmer" space
62 "Veggies" spaces/food items
64 designation on "Veggies" spaces identifying type of vegetable
66 designation on "Veggies" spaces assigning preparation/cooking time
70 "Boil" space
72 "Soup or Salad" spaces/food items
74 designation on "Soup or Salad" spaces identifying type of soup or salad
76 designation on "Soup or Salad" spaces assigning preparation/cooking time
80 "Stew" space
82 "Dessert" spaces/food items
84 designation on "Dessert" spaces identifying type of dessert
86 designation on "Dessert" spaces assigning preparation/cooking time

DETAILED DESCRIPTION OF THE PREFERRED EMBODIMENT

The following discussion describes in detail the preferred embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

FIG. 1 depicts the boxed game apparatus 10 on a typical game playing table 12. The object of the game is to assemble a four course meal and prepare/cook it. The first player to do so is the winner.

Figure 2:
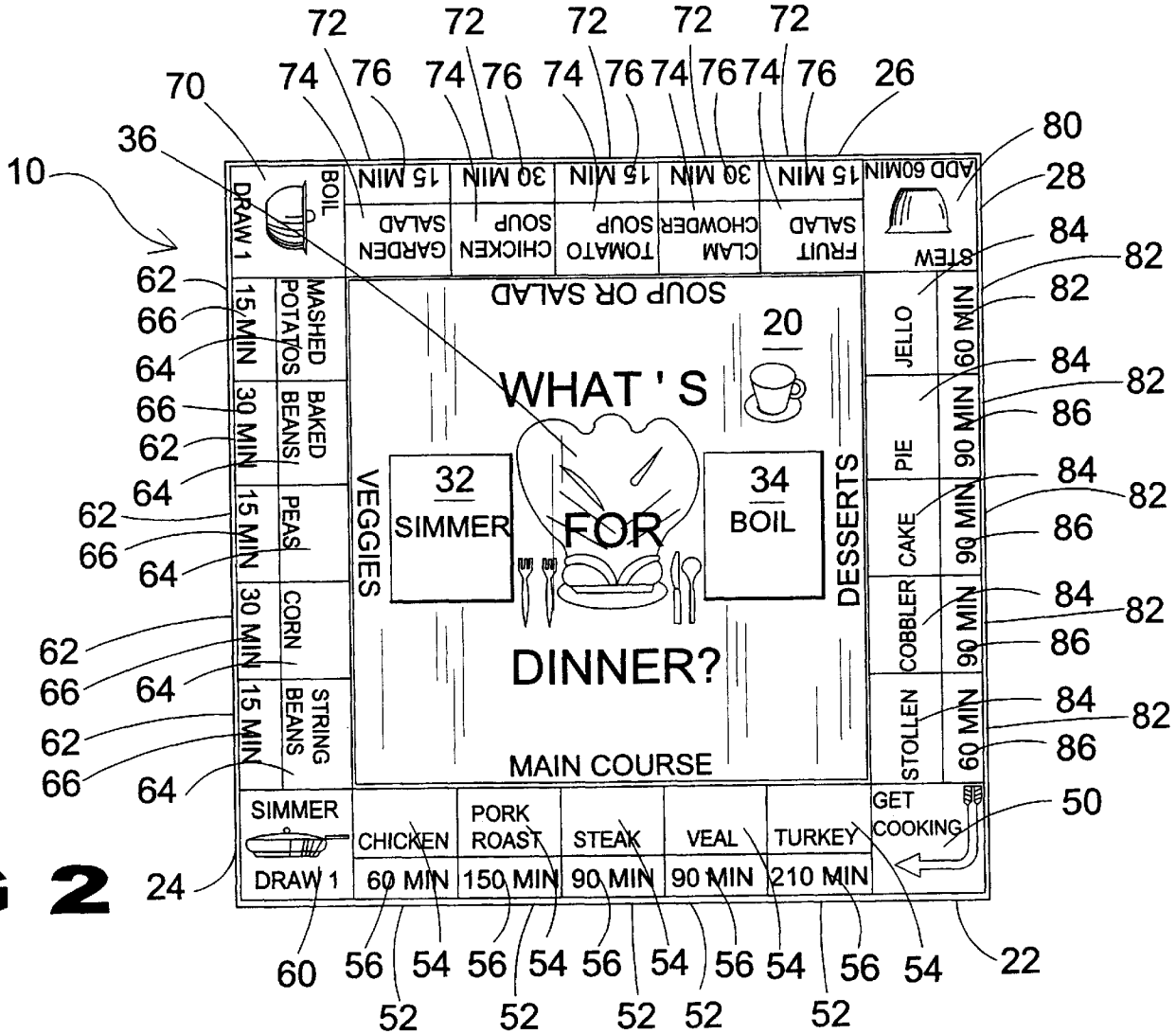
FIG. 2 is a top view of the present invention showing the present invention having a game board with the sides named after various food groups and within those groups a plurality of foods with said food's preparation/cooking time.

FIG. 2 is a top view of the game board 20 that, in the preferred embodiment, includes a first side 22, a second side 24, a third side 26 and a fourth side 28. Each side having delineated spaces on which to place the player's individual player token 30, example tokens 30 being shown in FIG. 1.

Figure 4:
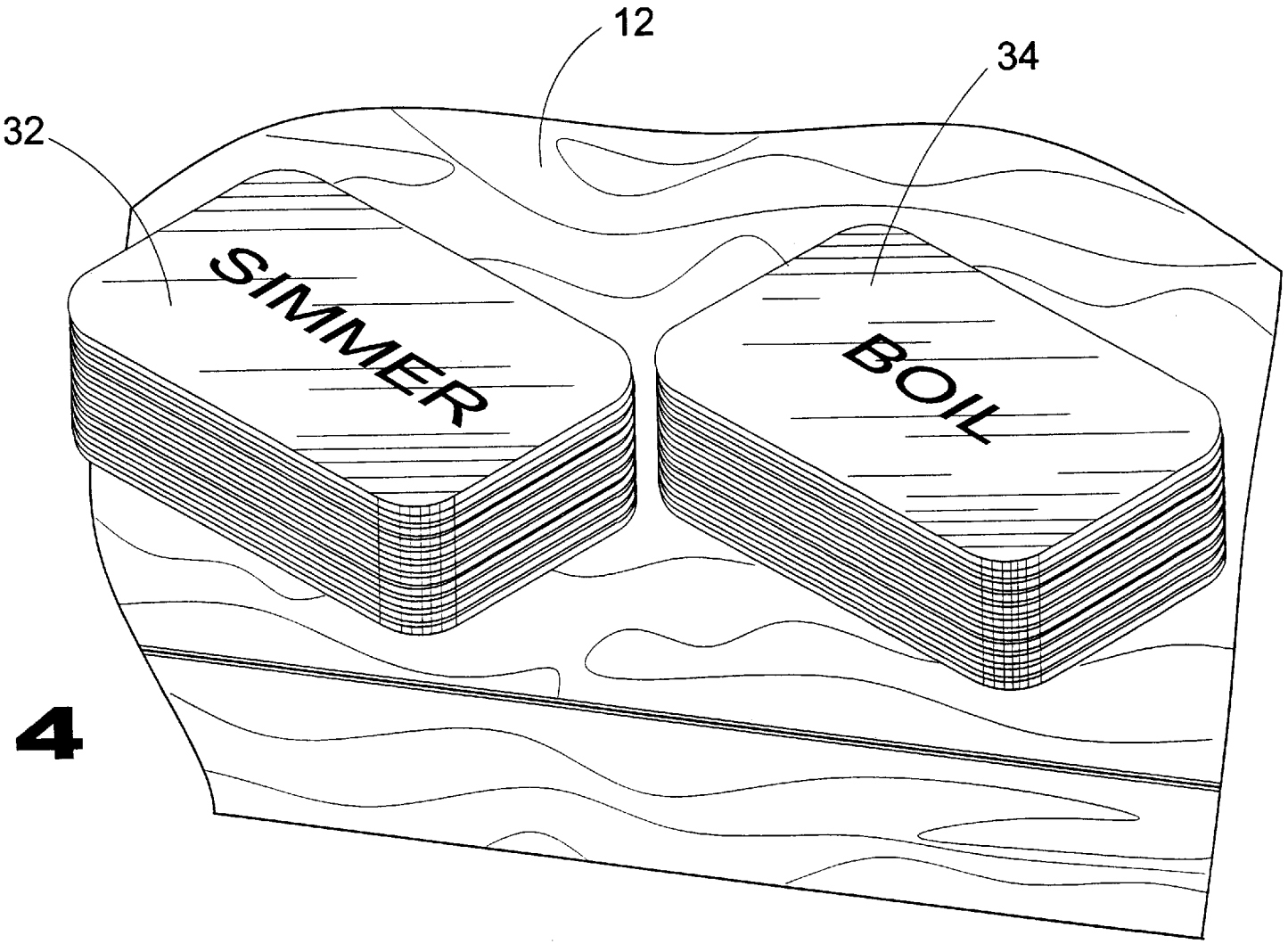
FIG. 4 is an isometric view of the present invention showing the present invention having two decks of cards one marked with the word "Simmer" and the other with the word "Boil" written thereon.

The board 20 also has one designated area for the face-down placement of a stack of "Simmer" cards 32, and a second designated area for the face-down placement of a stack of "Boil" cards 34, as shown in FIG. 2 and FIG. 4. A decorative title/image 36 is centered on the game board 20. A set of instructions 38 is also provided.

Figure 3:
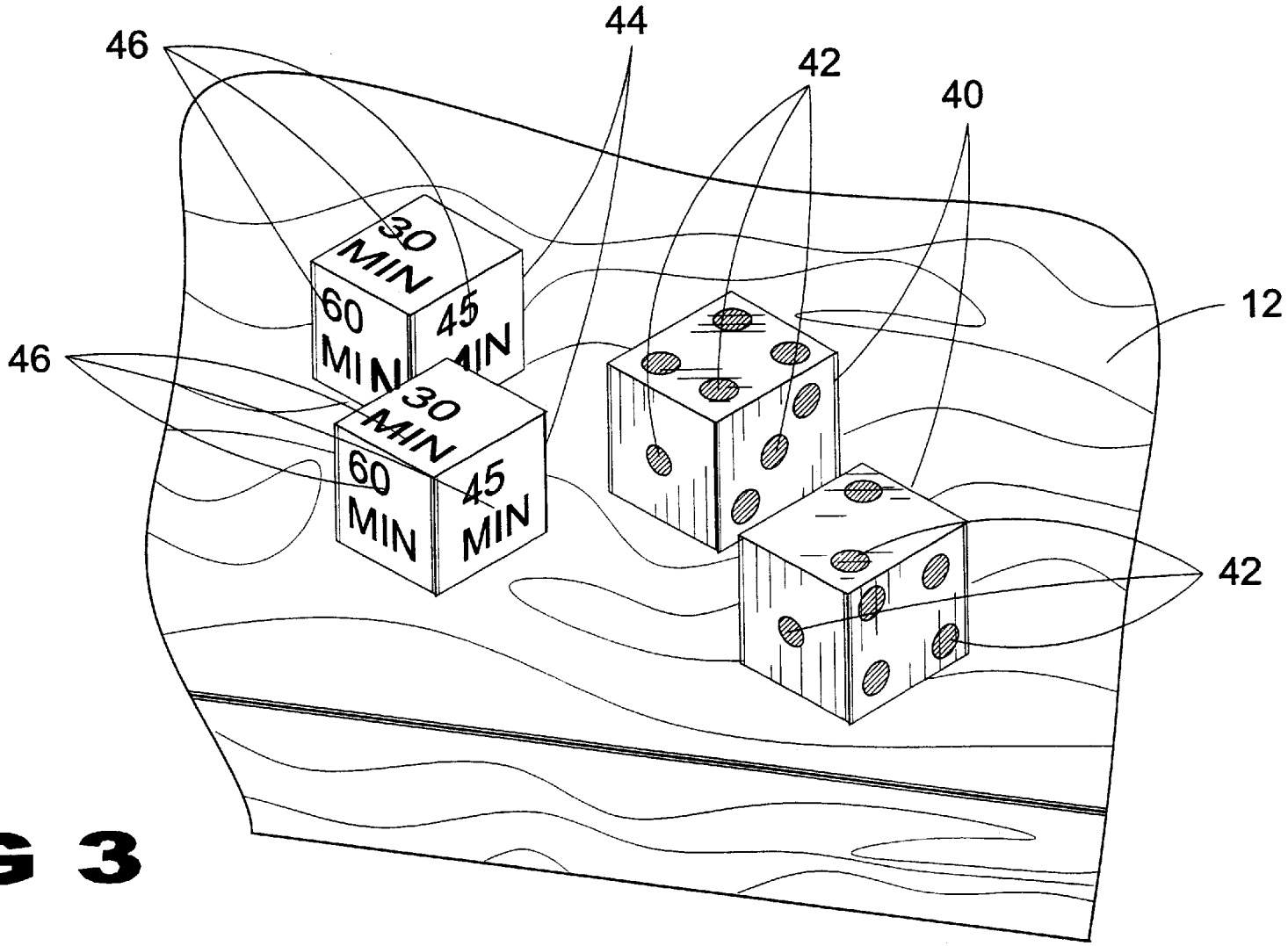
FIG. 3 is an isometric view showing the two pairs of dice, one pair having various food cooking/preparation times thereon, and one pair having number markings ranging from one to four.

As shown in FIG. 1 and FIG. 3, a first pair of dice 40 has number indicia 42, the highest number being four. When rolled, the first pair 40 displays two numbers that are summed, with the rolling player then moving his player token 30 that number of delineated spaces on the board 20. A second pair of dice 44 has text 46 reflecting amounts of preparation/cooking time.

As shown in FIG. 2, a starting space, the "Get Cooking" space 50, is on the first side 22. The player's tokens 30 are placed on the starting space at the beginning of the game. Spaced sequentially from the "Get Cooking" space 50 are five "Main Course" spaces 52 each representing a food item 52 in the "Main Course" food group. Each has a food type designation 54 describing a main course and a time amount designation 56 assigning an amount of preparation/cooking time to the particular main course.

The second side 24 begins with a "Simmer" space 60. Spaced sequentially from the "Simmer" space 60, are five "Veggies" spaces 62, each having a food type designation 64 describing a vegetable and a time amount designation 66 assigning an amount of preparation/cooking time to the particular vegetable.

The third side 26 begins with a "Boil" space 70. Spaced sequentially from the "Boil" space 70, are five "Soup or Salad" food item spaces 72, each having a food type designation 74 describing a soup or a salad and a time amount designation 76 assigning an amount of preparation/cooking time to the particular soup or salad.

The fourth side 28 begins with a "Stew" space 80. Spaced sequentially from the "Stew" space 80, are five "Dessert" food item spaces 82, each having a food type designation 84 describing a dessert and a time amount designation 86 assigning an amount of preparation/cooking time to the particular dessert.

The game begins with player tokens 30 on the "Get Cooking" space 50. The player rolls the numbered dice 40, sums the displayed numbers 42, and advances the token 30 the corresponding number of delineated spaces. If the player lands on a main course food item 52 the player notes the required preparation/cooking time 56 and is then in the process of preparing/cooking this food item.

If the player lands on the "Simmer" space 60, the player must draw a "Simmer" card 32, and follow the instructions. The instructions include, among other instructions, an instruction that causes the player to move his player token 30 to another space, or a number of spaces, as well as, an instruction that changes the preparation time with regard to the food item that the player is currently attempting to prepare.

Similarly, if the player later lands on the "Boil" space 70, the player draws a "Boil" card 34 and must comply with the instructions on the card 34. These instructions can include the instructions on the "Simmer" card, discussed above, or such instructions, and others, can be assigned between the "Simmer" and "Boil" cards 32,34 by the type of instruction. Other possible instructions for either or both can include, without limitation, the forfeiture of a food item during or after the preparation/cooking process, the transfer of the same to another player, an additional turn, a lost turn, the right to take another players completed food items 52,62, 72,82, and others.

If the player lands on the "Stew" space 80, the player must add the indicated amount of time to the accumulated preparation/cooking time for the food item 52,62,72,82 that the player is currently trying to prepare/cook.

When a player has landed on a first food item type 52 and entered the preparation/cooking process, the next step is to roll and move around the game board 20 on each successive turn until the player's token lands on the "Get Cooking" space 50. The player then rolls the second dice pair 44 and sums the displayed time amounts 46. This amount of time is taken from the total accumulated preparation/cooking time until all the accumulated preparation/cooking time is consumed. At this point the player is deemed to have fully prepared/cooked this first food item, and begins rolling the numbered dice 40 until the player lands on a second food item space, such as a vegetable food item 62, and again enters the preparation/cooking process for the second food item 62. This process proceeds the same as for the first food item 52, ending when the player has rolled the second dice pair 44 to eliminate the accumulated preparation/cooking time.

After the second food item 62 is thus completed, the player repeats the process for a third food item 72 and a fourth food item 82. The first player to so complete the fourth food item 82 has thus completed the preparation/cooking of the four course dinner, and is deemed the winner.

The invention contemplates a requirement that the four food items be completed in order, and also a version where the four food items can be completed in any order.

With respect to the above description then, it is to be realized that the optimum material and dimensional relationships for the components of the What's For Dinner game apparatus 10, will include variations in size, materials, shape, and form, which will occur to those skilled in the art upon review of the present disclosure. For example, additional instructions can be added to the "Boil" and "Simmer" cards 32,34 other designs for tokens 30 can be chosen, other food types 54,56,58,60 and preparation/cooking time amounts 56,66,76,86 can be substituted, and varying time amounts 46 and numbers 42 can be substituted on the first and second dice pairs 40,44. All equivalent relationships to those illustrated in the drawings and described in the specification are intended to be encompassed by the present invention.

What is claimed as new and desired to be protected by letters patent is set forth in the appended claims:

1. A board game for a number of players, the game designed to select and prepare food items for a meal, each player accumulating a total food preparation time during play for each food item, the apparatus comprising:

at least two player tokens;

at least one numbered die having at least four sides, each side having a number displayed;

a game board defining a platform upon which the game is played, the board having at least four sides, each side representing a group of food items, each side having a plurality of individual spaces delineated for player token advancement according to a roll of the at least one die, each delineated space representing and displaying an item of food within the group of food items represented by the side on which the space is located, and each delineated space displaying a time indicia indicating the amount of preparation time required for the item of food displayed on said delineated space, one of said game board sides having a delineated space for player token occupation at the game beginning, and one of said game board sides having a delineated preparation time penalty space displaying the amount of the time penalty;

at least one time indicia die having at least four sides, each side having an amount of time displayed;

at least one stack of cards, each card having an instruction, with at least one card's instruction affecting the player's board position, and with at least one card's instruction affecting the player's total preparation time accumulation, the game board further having a designated area for placement of the at least one stack of cards, the game board further having at least one delineated space having an instruction to draw from the at least one stack of cards.

2. The board game of claim 1, wherein the number of numbered die is two and the highest combination of displayed numbers equals four.

3. The board game of claim 1, wherein the number of numbered die is two and the highest combination of displayed numbers equals eight.

4. The board game of claim 1, wherein the at least one numbered die is six-sided.

5. The board game of claim 1, wherein the at least one numbered die is eight-sided.

6. The board game of claim 1, wherein the at least one time indicia die is six-sided.

7. The board game of claim 1, wherein the at least one time indicia die is eight-sided.

8. The board game of claim 1, wherein the number of stacks of cards is two.

9. The board game of claim 8, wherein the first stack has cards labeled "Simmer" and the second stack has cards labeled "Boil".

10. The board game of claim 1, wherein the starting space is labeled "Get Cooking".

11. The board game of claim 1, wherein one game board side is for the main course food group.

12. The board game of claim 1, wherein one game board side is for the vegetable food group.

13. The board game of claim 1, wherein one game board side is for the food group including soups and salads.

14. The board game of claim 1, wherein one game board side is for the dessert food group.

15. The board game of claim 1, further comprising a set of instructions.

16. A method of playing a board game for a number of players, the game designed to select and prepare food items for a meal, each player accumulating a total food preparation time during play for each food item, the comprising the steps of:

providing at least two player tokens;

providing at least one numbered die having at least four sides, each side having a number displayed;

providing at least one time indicia die having at least four sides, each side having an amount of time displayed;

providing a game board defining a platform upon which the game is played, the board having at least four sides, each side representing a group of food items, each side having a plurality of individual spaces delineated for player token advancement according to a roll of the at least one die, each delineated space representing and displaying an item of food within the group of food items represented by the side on which the space is located, and each delineated space displaying a time indicia indicating the amount of preparation time required for the item of food displayed on said delineated space, one of said game board sides having a delineated space for player token occupation at the game beginning, and one of said game board sides having a delineated preparation time penalty space displaying the amount of the time penalty;

providing at least one stack of instruction cards, each card having an instruction, with at least one card's instruction affecting the player's board position, and with at least one card's instruction affecting the player's total preparation time accumulation, the game board further having a designated area for placement of the at least one stack of cards, the game board further having at least one individual delineated space having an instruction to draw from the at least one stack of cards;

placing the at least one stack of cards face down in the designated area on the game board;

placing the player tokens on the delineated starting space;

requiring each player to roll the at least one numbered die and to advance said player's token a number of delineated spaces to correspond with the numbered displayed on the die following the roll;

requiring each player to draw an instruction card when said player's token lands on the at least one delineated space that indicates the instruction card is to be drawn, and to follow the instruction on the drawn instruction card;

requiring each player to prepare a four course meal including one food item from each side of the game board, the inclusion resulting from said player's token landing on the food item;

as each food item is so included:

requiring the player to roll the at least one numbered die and advance said player's token until said player's token lands on a delineated food preparation space;

requiring the player to roll the at least one time indicia die until time amounts displayed on the rolled die equals or exceeds the newly included food item's designated preparation time, as adjusted by any preparation time adjustments that are made per the instruction card instructions or the preparation time penalty space penalty;

requiring the player to return to the numbered die after so equaling or exceeding said time amounts for the first three included food items;

declaring the player who equals or exceeds said time amounts for the fourth included food item as the winner.

17. The method of claim 16, wherein the delineated food preparation space is labeled "Get Cooking".

18. The method of claim 16, wherein the delineated food preparation space is labeled "Get Cooking" and is the same space as the starting space for player tokens.

19. The method of claim 16, wherein one game board side is for the main course food group.

20. The method of claim 16, wherein one game board side is for the vegetable food group.

21. The method of claim 16, wherein one game board side is for the food group including soups and salads.

22. The method of claim 16, wherein one game board side is for the dessert food group.

* * * * *